United States Patent [19]

Thompson

[11] Patent Number: 5,044,976

[45] Date of Patent: Sep. 3, 1991

[54] ELECTRICAL CORD HOLDING DEVICE AND METHOD FOR USING SAME

[76] Inventor: Dennis L. Thompson, 6411 Franklin Ave., Des Moines, Iowa 50322

[21] Appl. No.: 600,729

[22] Filed: Oct. 22, 1990

[51] Int. Cl.[5] ..... H01R 13/62

[52] U.S. Cl. ..... 439/368; 439/371; 439/373

[58] Field of Search ..... 439/345, 347, 348, 368, 439/369, 371, 373, 449, 451, 452, 464, 470, 471

[56] References Cited

U.S. PATENT DOCUMENTS

| | | | |
|---|---|---|---|
| 2,569,037 | 9/1951 | Dalton | 439/373 X |
| 3,538,484 | 11/1970 | Passafiume | 439/373 X |
| 3,708,778 | 1/1973 | McKeever | 439/371 X |
| 3,775,729 | 11/1973 | Casper | 439/371 X |
| 4,066,313 | 1/1978 | von dem Hagen | 439/371 X |
| 4,566,185 | 1/1986 | Bryan et al. | 439/371 X |
| 4,618,200 | 10/1986 | Roberts et al. | 439/373 X |
| 4,917,626 | 4/1990 | Barton | 439/371 X |

FOREIGN PATENT DOCUMENTS

| | | | |
|---|---|---|---|
| 1152176 | 8/1983 | Canada | 439/373 |

OTHER PUBLICATIONS

*IBM Technical Disclosure Bulletin,* "Retaining Strap Arrangement", vol. 21, No. 2, 7-87, p. 762.

*Primary Examiner*—Larry I. Schwartz
*Assistant Examiner*—Julie R. Daulton
*Attorney, Agent, or Firm*—Zarley, McKee, Thomte, Voorhees & Sease

[57] ABSTRACT

An electrical cord holder includes an elongated member which can be secured to a conventional electrical outlet in a position whereby the elongated member extends perpendicularly away from the wall plate of the outlet. A clamp is detachably secured around the electrical cord immediately adjacent the plug while the plug is inserted within the wall outlet. The clamp is then detachably secured to the elongated member so as to prevent the plug from being pulled out of the outlet.

4 Claims, 1 Drawing Sheet

ELECTRICAL CORD HOLDING DEVICE AND METHOD FOR USING SAME

BACKGROUND OF THE INVENTION

The present invention relates to an electrical cord holding device and method for using same.

One problem commonly encountered with electrical appliances which are plugged into a wall outlet is that the plug can be easily pulled out of the plug outlet during use of the appliance. Therefore, it is desirable to provide a device which will securely hold the plug within the plug outlet during the time that the appliance is being used.

Therefore, a primary object of the present invention is the provision of an improved electrical cord holding device and method for using same.

A further object of the present invention is the provision of a holding device which can be quickly and easily attached to and detached from the electrical cord.

A further object of the present invention is the provision of an electrical cord holding device which can be used for a dual wall outlet having two electrical receptacles for receiving two plugs.

A further object of the present invention is the provision of an electrical cord holding device and method for using same which is economical to manufacture, durable in use, and efficient in operation.

SUMMARY OF THE INVENTION

The present invention utilizes an elongated rigid member which can be attached to the wall outlet between the two dual plug receptacles of the outlet. The elongated member extends perpendicularly away from the wall plate and terminates at an outer end. The device is adapted for use with an electrical cord which has a plug at one end thereof. When the prongs of the plug are within the plug receptacle, the elongated member of the present device extends parallel to the plug body and the cord.

A clamp is adapted to be clamped to the cord immediately adjacent the plug body and includes securing means thereon for attachment to the elongated member which is attached to the wall outlet. The securing means may be one of a various number of securing devices, but the preferred securing device is a combination of hook members and eye members mounted on the clamp and the elongated member respectively. These hook members and eye members are adapted to retentively engage one another and are commonly referred to by the registered trademark "Velcro".

In operation, the elongated member is attached to the wall outlet by means of the screw normally used to attach the wall plate to the plug receptacles. The plug is then inserted into the receptacle. The clamp is then clamped around the electrical cord immediately adjacent the plug, and the Velcro eye members on the clamp are engaged with the Velcro hook members on the elongated member to secure the two together. Under this arrangement, the elongated member and the clamp will prevent the plug from being pulled out of the outlet when the cord is pulled away from the outlet. The device is simple in construction and can be utilized in combination with any conventional electrical outlet.

DESCRIPTION OF THE PREFERRED EMBODIMENT

Figure 1:
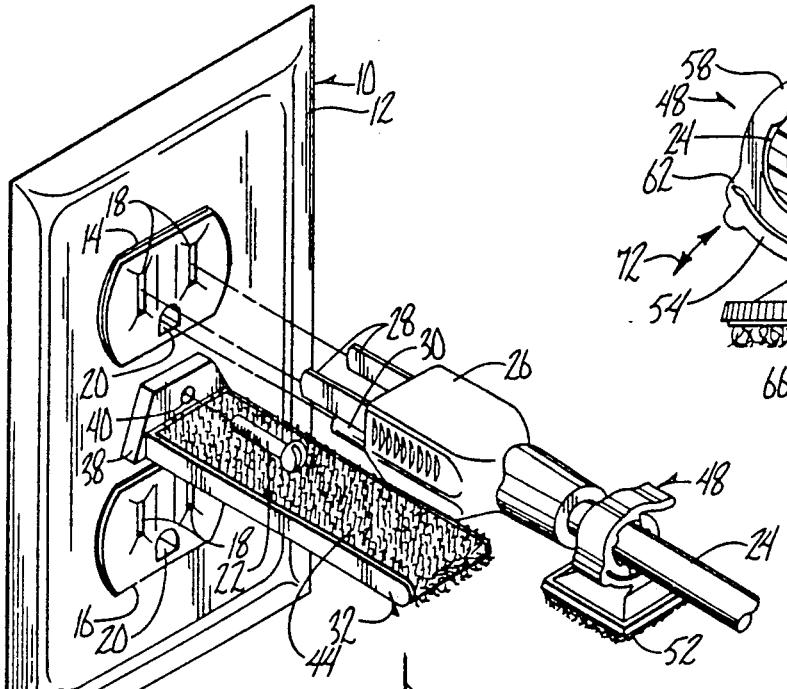
FIG. 1 is an exploded perspective view of a wall outlet utilizing the cord holding device of the present invention.

Referring to the drawings, the numeral 10 generally designates an electrical wall outlet having a receptacle plate 12, an upper receptacle 14, and a lower receptacle 16. Receptacles 14, 16 include a pair of plug channels 18 and a singular ground channel 20. Receptacle plate 12 is secured to the upper and lower receptacles by means of a plate screw 22.

An electrical cord 24 includes a plug body 26 secured at one end thereof. Plug body 26 has a pair of prongs 28 and a ground prong 30 extending axially therefrom. Prongs 28, 30 are adapted to fit within plug channels 18 and ground channel 20.

The cord holding device of the present invention comprises an elongated member 32 and a clamp device 48. Elongated member 32 includes a flat upper surface 34, a flat lower surface 36, a mounting flange 38 having a mounting hole 40 therein, and an outer end 42. Mounted on the upper surface 34 is an upper Velcro pad 44, and mounted on the lower surface 36 is a lower Velcro pad 46.

Clamp 48 includes a base 50 having a pad 52 mounted on the lower surface thereof. Pad 52 includes plurality of hook members thereon, and upper and lower pads 44, 46 include a plurality of eye members thereon which are adapted to retentively engage the hook members of pad 52. It is possible to reverse the hook members and eye members between pad 52 and pads 44, 46.

Extending upwardly from base 50 of clamp device 48 are a pair of spring arms 54, 56 which are adapted to yieldably spring toward and away from one another. Clamp device 48 also includes a first clamp member 58 and a second clamp member 60 which are joined together by means of a living hinge 66. Clamp member 58 is joined to spring arm 54 by means of a living hinge 62, and clamp member 60 is joined to spring arm 56 by means of a living hinge 64. The end of clamp member 58 includes a slot 68 in which may be fitted the tip 70 of clamp member 60.

Figure 4:
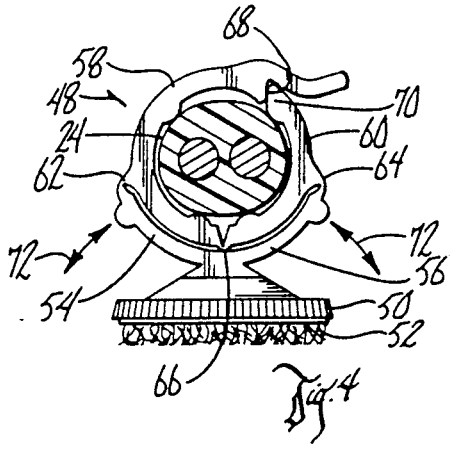
FIG. 4 is a sectional view taken along line 4—4 of FIG. 2.
Figure 3:
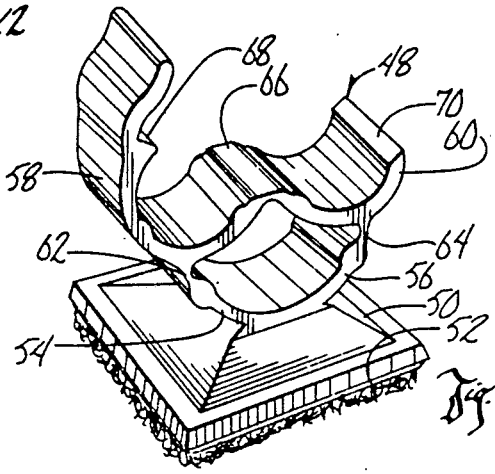
FIG. 3 is a perspective view of the clamp device utilized with the present invention.

FIG. 3 illustrates the clamp members 58, 60 in their open or spread position, and FIG. 4 illustrates the clamp members 58, 60 in their closed position. In moving from the open to the closed position, living hinge 66 moves downwardly from the position shown in FIG. 3 to a lower position shown in FIG. 4. This causes a corresponding movement of the arms 58, 60 from their spread position shown in FIG. 3 to their closed position shown in FIG. 4. Simultaneously, the living hinges 62, 64 are forced away from one another in the direction indicated by arrows 72 during the movement of the spring arms 58, 60 from their open to their closed positions. However, when the clamp arms 58, 60 reach their closed position shown in FIG. 4, the spring arms 54, 56 are permitted too spring radially inwardly toward one another thereby forcing the clap arms 58, 60 to be yieldably held in their closed position. During this movement from the open to the closed positions of clamp arms 58, 60, the hinge 66 operates in a toggle like fashion.

In operation, the elongated member 32 is attached to the wall outlet 10 by means of screw 22 which extends through the mounting hole 40 and mounting flange 38. In this position, the longitudinal axis of elongated member 32 is approximately perpendicular to the surface of the wall plate or receptacle plate 12. The prongs 28, 30 of plug member 26 are then inserted into the plug channels 18, 20 of upper receptacle 14. Clamp device 48 is then clamped to the cord 24 immediately adjacent the plug body 26 in the manner shown in FIGS. 1 and 2. This clamping is accomplished by moving the clamp arms 58, 60 from their open position shown in FIG. 3 to their closed position shown in FIG. 4 so that the clamp arms 58, 60 surround and retentively engage the cord 24.

The pad 52 of clamp device 48 is then placed in retentive engagement with the upper pad 44 of elongated member 42 in the manner shown in FIG. 4, thereby detachably securing the two there together. When the cord 24 is pullled, the clamp 48 and the elongated member 32 hold the plug 26 tightly within the upper receptacle 14.

Figure 2:
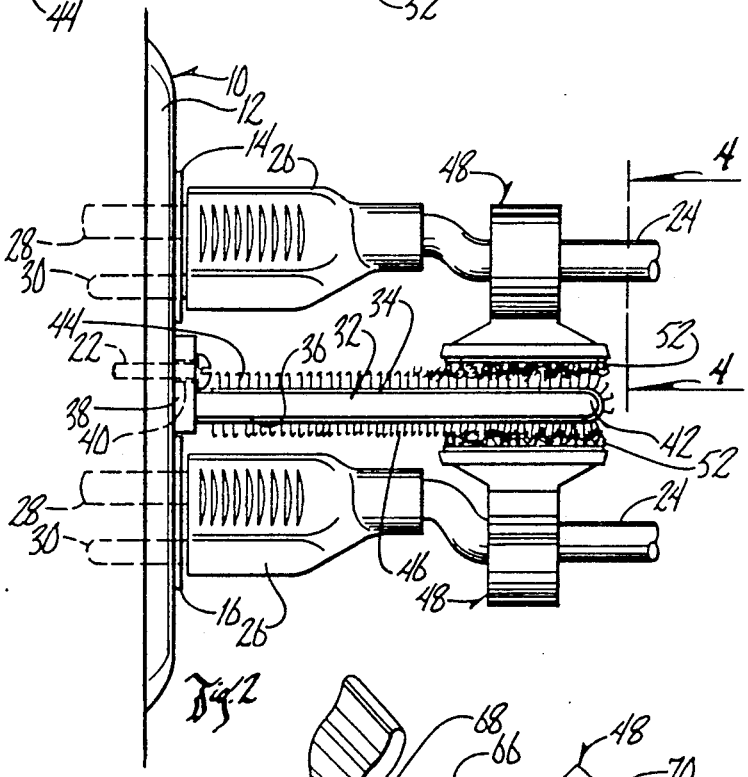
FIG. 2 is a side elevational view of the cord holding device of the present invention used in combination with a dual electrical outlet.

As can be seen in FIG. 2, a second plug 26 can be inserted into the lower receptacle 16 and can be secured to the lower pad 46 on the under surface 36 of elongated member 32.

The cord holding device of the present invention is simple and easy too use. It can be quickly attached to any conventional wall outlet, and the Velcro attachments between clamp devices 48 and the elongated member 32 permit the clamps to accommodate plugs of varying sizes and shapes. It is preferable that the clamp 48 be placed close to the plug bodies 26 to achieve the maximum securing force for the cord 24. Thus it can be seen that the device accomplishes at least all of its stated objectives.

I claim:

1. An electrical cord holding device for use with a plug receptacle and an electric cord having a plug at one end thereof, said plug having an elongated plug body having a first end connected to said cord and having a second end, a pair of prongs protruding from said second end of said plug body and being matingly fitted within said plug receptacle a receptacle plate surrounding said plug receptacle and extending in a first plane approximately perpendicular to the longitudinal axis of said plug body, said holding device comprising:

an elongated member having a longitudinal axis and first and second opposite ends;

first securing means securing said second end of said elongated member to said receptacle adjacent said plug body and supporting said elongated member with said longitudinal axis thereof extending in a direction approximately parallel to said longitudinal axis of said plug body, said first end of said elongated member being adjacent said cord and said first end of said plug body;

clamp means detachably retentively engaging a portion of said cord adjacent said first end of said elongated member;

said clamp means comprising a pair of clamp members, at least one of said clamp members being movable from a closed position wherein said clamp members surround and retentively engage said cord to an open position wherein said clamp members are separated from one another too permit said cord to be removed therefrom;

second securing means detachably securing said clamp means to said elongated member for preventing said prongs from being pulled out of said receptacle when said cord is pulled in a direction away from said receptacle;

said second securing means comprising a group of hook members on one of said clamp means and said elongated member and a group of eye members on the other of said clamp means and said elongated member, said hook members and said eye members retentively engaging one another.

2. A cord holding device according to claim 1 wherein said clamp means further comprises a clamp base, said group of hook members being on one of said clamp base and said elongated member, and said group of eye members being on the other of said clamp base and said elongated member.

3. A cord holding device according to claim 1 comprising a second plug receptacle spaced from said first mentioned plug receptacle, a second cord having a second plug at one end thereof, said second plug having an elongated second plug body with a first end connected to said second cord and with a second end, a second pair of prongs extending from said second end of said second plug body and retentively fitted within said second plug receptacle, said first securing means and said elongated member being positioned between said first and second plugs, second clamp means detachably retentively engaging a portion of said cord adjacent said first end of said elongated member, third securing means detachably securing said second clamp means to said elongated member for preventing said second pair of prongs from being pulled out of said second receptacle when said second cord is pulled in a direction away from said receptacle.

4. A cord according to claim 3 wherein said third securing means comprises a second group of hook members on one of said clamp means and said elongated member, and a second group of eye members on the other of said elongated member and said clamp means.

* * * * *